US006058636A

United States Patent [19]

Colkmire

[11] Patent Number: 6,058,636

[45] Date of Patent: May 9, 2000

[54] APPARATUS AND METHOD FOR PRESERVING POTABLE WATER

[75] Inventor: Steve G. Colkmire, Albany, La.

[73] Assignee: Floyd H. Hutchinson, Holden, La.

[21] Appl. No.: 09/027,066

[22] Filed: Feb. 20, 1998

[51] Int. Cl.[7] ..... G09F 3/10; B67D 5/06; B65D 41/00

[52] U.S. Cl. ..... 40/630; 40/638; 40/306; 222/23; 215/232; 220/359.1

[58] Field of Search ..... 40/638, 310, 306, 40/665, 630, 312; 215/365, 250, 251, 253, 232; 222/23; 220/359.1, 265, 266

[56] References Cited

U.S. PATENT DOCUMENTS

| | | | |
|---|---|---|---|
| 3,740,081 | 6/1973 | Whipperman | 40/310 X |
| 3,951,292 | 4/1976 | Amberg | 215/232 X |
| 4,000,824 | 1/1977 | Han | 215/232 |
| 4,128,954 | 12/1978 | White | 40/310 |
| 4,652,473 | 3/1987 | Han | 215/246 X |
| 5,046,609 | 9/1991 | Mangini et al. | 40/310 X |
| 5,207,746 | 5/1993 | Jones | 40/310 X |
| 5,329,713 | 7/1994 | Lundell | 40/638 X |
| 5,411,295 | 5/1995 | Bates et al. | 40/310 X |
| 5,820,951 | 10/1998 | Osborne | 215/365 X |

*Primary Examiner*—Brian K. Green
*Assistant Examiner*—Rodrigo J. Morales
*Attorney, Agent, or Firm*—Shawn D. Sentilles

[57] ABSTRACT

An apparatus and method for securing a closed lid on a water cooler containing potable water, and for labeling the water cooler, the apparatus comprising a safety seal tape and a safety tag. An outer side of the safety seal tape is imprinted with repeating indicia indicating that the lid is not to be removed from the cooler. An outer side of the safety tag is imprinted with indicia indicating that the cooler contains potable water. Inner sides of the tape and tag have a pressure sensitive adhesive which is capable of removably bonding the tape and tag to the water cooler. The tape is wrapped around the closed lid to secure the lid on the cooler, and the tag is adhered to the cooler, the tape and tag together providing notice that the cooler contains potable water and that the lid is not to be removed. The safety tag can be provided with various features which can be incorporated into a record keeping system for verifying compliance with applicable regulations.

25 Claims, 3 Drawing Sheets

APPARATUS AND METHOD FOR PRESERVING POTABLE WATER

FIELD OF THE INVENTION

The present invention relates to potable water, and more particularly to an apparatus and method for maintaining potable water in water coolers and verifying the potability of water sources.

BACKGROUND OF THE INVENTION

Part 1926 of Title 29 of the Code of Federal Regulations (C.F.R.) contains extensive, detailed, and sometimes stringent safety and health regulations pertaining to protecting the safety and health of construction workers. The regulations set forth in 29 C.F.R. 1926 are promulgated and enforced by the Occupational Safety and Health Administration (OSHA) of the U.S. Department of Labor. OSHA has the authority to levy stiff fines for failure to comply with 29 C.F.R. Part 1926.

The present invention is directed toward promoting compliance with 29 C.F.R. § 1926.051(a), which pertains to providing and maintaining potable water for construction workers, and such other applicable regulations as may be promulgated from time to time. 29 C.F.R. § 1926.051(a) provides:

(1) An adequate supply of potable water shall be provided in all places of employment.

(2) Portable containers used to dispense drinking water shall be capable of being tightly closed, and equipped with a tap. Water shall not be dipped from containers.

(3) Any container used to distribute drinking water shall be clearly marked as to the nature of its contents and not used for any other purpose.

(4) The common drinking cup is prohibited.

(5) Where single service cups (to be used but once) are supplied, both a sanitary container for the unused cups and a receptacle for disposing of the used cups shall be provided.

(6) Potable water means water which meets the quality standards prescribed in the U.S. Public Health Service Drinking Water Standards, published in 42 C.F.R. part 72, or water which is approved for drinking purposes by the State or local authority having jurisdiction.

In order to comply with 29 C.F.R. 1926.51(a), as well as for practical reasons, most drinking water on construction sites is provided in conventional insulated water coolers. Such coolers have a spigot-type tap located near the bottom of the cooler, and a large opening on the top of the cooler. The large opening makes the coolers easy to clean and easy to fill with ice and potable water. After the cooler has been filled with potable water, the large opening can be tightly sealed with a lid, which is usually a screw cap lid. When properly cleaned, filled with potable water, and sealed with the screw cap lid, such coolers provide a convenient source of potable water which complies with 29 C.F.R. 1926.51(a).

However, a problem which frequently occurs on construction sites is that workers remove the screw cap lids. This can be accomplished simply by unscrewing the lid. Workers open the lids to grab pieces of ice, dip cups into the water, stick their arms into the ice water to cool off, and even to place beverage containers, such as cans of soda or beer, in the water cooler. These activities, if discovered by OSHA, often lead to heavy fines being imposed on the employer. A large construction site or a large industrial site, such as a manufacturing plant, may require several hundred coolers on a daily basis, greatly increasing the chance that at least some of the coolers will be opened and tampered with.

Several methods are presently being used in an effort to prevent construction workers from opening water cooler lids. One method is to instruct workers not to open the lids. Such instructions typically include a warning that a worker caught opening a lid will be discharged. However, such instructions and warnings have been largely unsuccessful in preventing workers from opening lids. Another method is to place the coolers on raised stands so that it is difficult for workers to reach and open the lids. A major drawback of this method is that the coolers, which may weigh over a hundred pounds when filled with potable water, are difficult to lift onto the stands. Additionally, because ladders and other structures are readily available on construction sites, workers can improvise ways of accessing the lid.

Perhaps the most successful method presently in use is to tape the lids onto the water coolers with duct tape. Duct tape is readily available in retail stores and is commonly used for a variety of household and industrial purposes. Duct tape is strong, inexpensive, and is sold in wide widths, all of which make it ideal for the task of sealing a large number of water coolers on a daily basis. Although the use of duct tape makes it more difficult to open lids, workers continue to open lids. Because duct tape is readily available on the open market, including in retail stores such as hardware stores and supermarkets, workers can hide the evidence of tampering merely by re-taping the lid onto the cooler with new duct tape. Additionally, the duct tape is not imprinted with a warning label, and therefore does not serve to clearly mark the water cooler as to the nature of its contents, as required by 29 C.F.R. § 1926.51(c). Because large numbers of coolers must be cleaned, filled, and taped daily in a short period of time, it is not practical to write warning labels on the duct tape.

As far as is known, no patents have been directed to solutions for solving the problem of maintaining potable water on construction sites.

Additionally, as far as is known, labeling systems have not been provided for labeling and recording the labeling of potable water coolers.

Accordingly, there is a need for an apparatus and method for preserving the potability of water on construction sites, manufacturing plants, and other industrial and commercial settings, and to thereby promote compliance with 29 C.F.R. § 1926.51(a) and other applicable regulations.

OBJECTS AND SUMMARY OF THE INVENTION

It is an object of the invention to provide a system for preserving potable water in water coolers, including at construction sites, manufacturing plants, other industrial and commercial settings, sporting events, and recreational events.

It is another object of the invention to provide a sealing and labeling system which promotes compliance with applicable regulations.

It is another object of the invention to provide a recording system for verifying and demonstrating compliance with applicable regulations.

It is another object of the invention to provide a sealing system which can be retrofit to existing water coolers.

It is yet another object of the invention to provide an economical system for tightly sealing water coolers.

These and other objects and advantages of the invention shall become apparent from the following general and preferred description of the invention.

Accordingly, an apparatus and method for securing a closed lid on a water cooler containing potable water and for labeling the water cooler are provided. The apparatus comprises a safety seal tape and a safety tag. An outer side of the safety seal tape is imprinted with repeating indicia. The repeating indicia indicating that the lid is not to be removed from the cooler, such as repetitions of the phrase "—potable water seal—do not remove." An inner side of the tape has a pressure sensitive adhesive thereon. The adhesive is capable of removably bonding the safety seal tape to the water cooler and the lid. An outer side of the safety tag is imprinted with indicia indicating that the cooler contains potable water. An inner side of the safety tag has a pressure sensitive adhesive on at least a portion thereof. The adhesive is capable of removably bonding the tag to the water cooler and the lid.

The apparatus is used by wrapping the safety seal tape around the closed lid and the water cooler such that the inner side of the tape adheres to the water cooler and the closed lid to thereby secure the closed lid on the water cooler, and such that the repeating indicia on the outer surface of the safety seal tape are visible on the water cooler to thereby label the water cooler, and by adhering the safety tag to the water cooler such that the indicia on the tag are visible on the water cooler to thereby label the water cooler.

The invention provides a number of ways of preserving records of when coolers were filled with potable water and secured with the invention. The indicia imprinted on the safety tag can include indicators for one or more spaces for recording information about the potable water on the safety tag. The indicia imprinted on the safety tag can also include a serial number, the serial number selected from a sequential series of serial numbers. A detachable label can be provided on the safety tag. The detachable label can be imprinted with indicia. The indicia on the detachable label can include indicators for one or more spaces for recording information about the potable water on the detachable label. The indicia imprinted on the detachable label can further include a second serial number, the second serial number being the same number as the serial number on the safety tag. The detachable label can be provided with a pressure sensitive adhesive which is coated with a back so that the adhesive does not adhere to the water cooler. Records can be maintained of the information provided on the safety tags and detachable labels in order to verify compliance with applicable regulations.

PREFERRED EMBODIMENTS OF THE INVENTION

Figure 1:
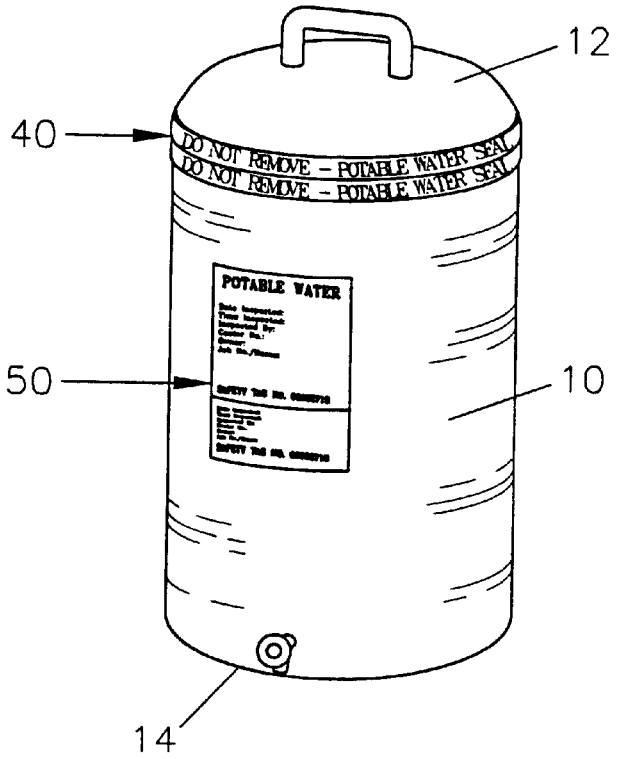
FIG. 1 is a frontal view of a water cooler having a closed lid secured and labeled according to the invention.

As shown in FIG. 1, the apparatus and methods of the invention are used to secure a closed lid 12 on a water cooler 10 having a tap 14 and containing potable water, and to label the water cooler 10 with indicia indicating that the lid 12 is not to be opened. Preferred embodiments of the invention will now be described.

Figure 2:
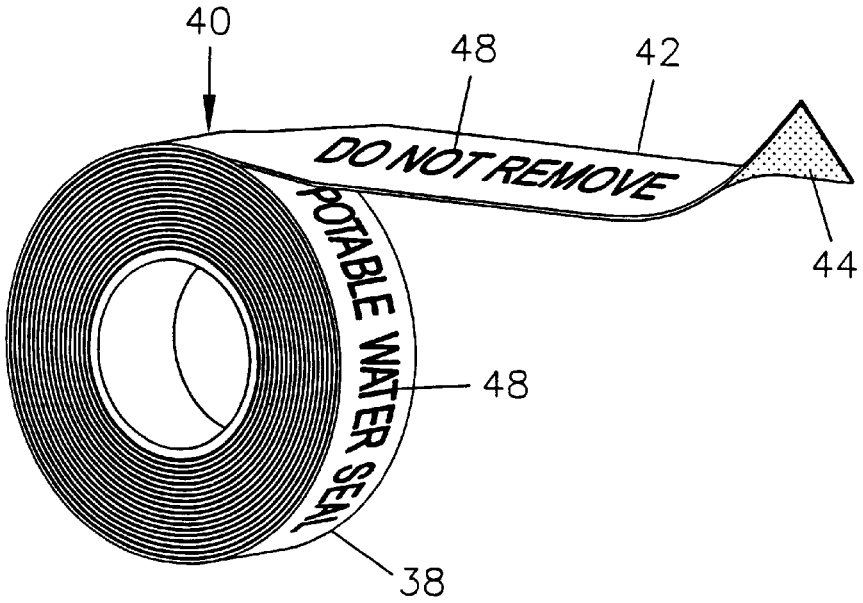
FIG. 2 is a perspective view of one embodiment of a safety seal tape according to the invention, showing outer and inner sides of the tape, and a preferred repeating indicia imprinted on the outer side of the tape.
Figure 3:
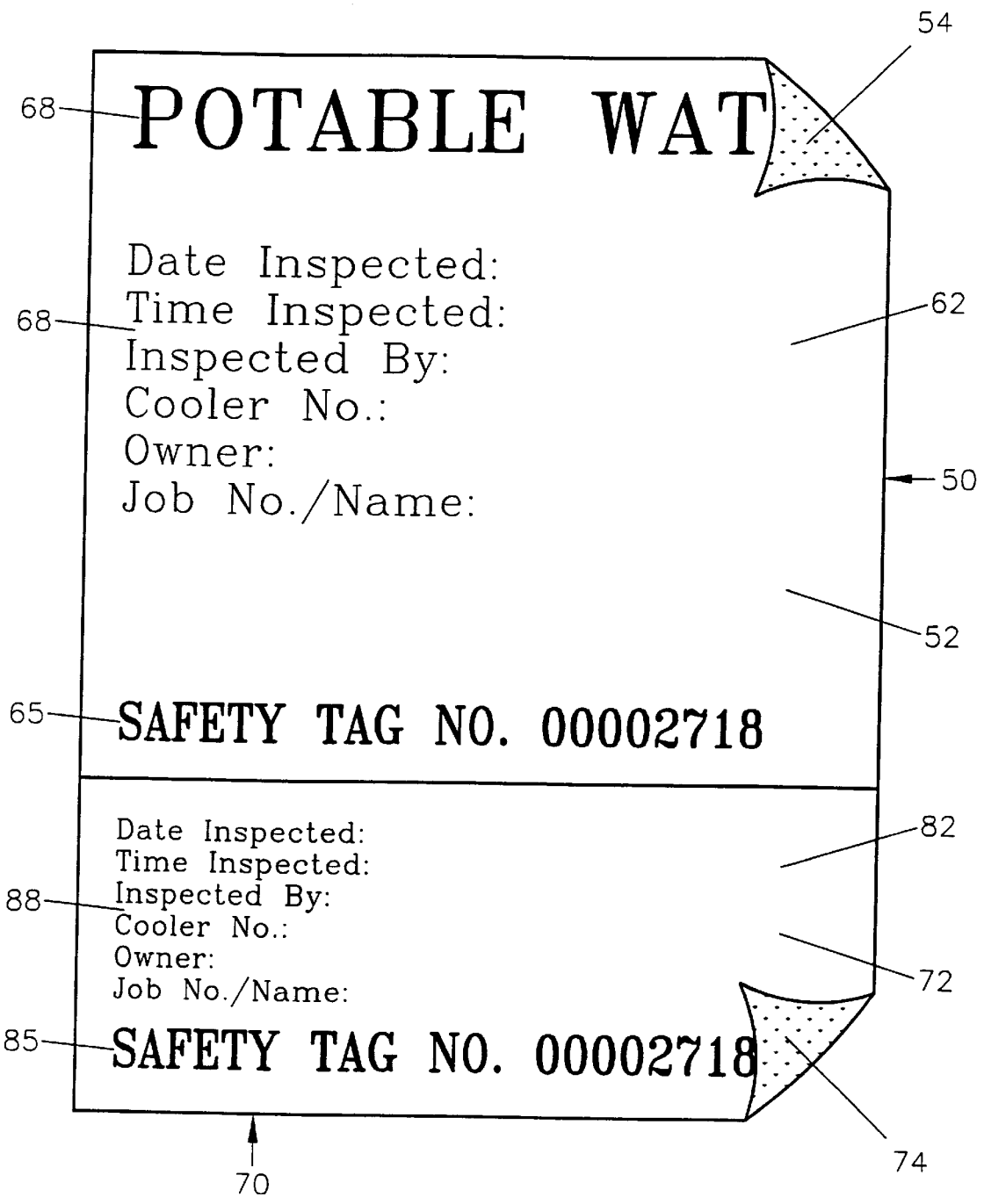
FIG. 3 is a frontal view of an outer side of one embodiment of a safety tag according to the invention, showing preferred indicia imprinted thereon and showing an overlap of the inner side of the safety tag.

As shown in FIGS. 1, 2, and 3, the apparatus comprises a safety seal tape 40 and a safety tag 50. As shown in FIG. 2, the safety seal tape 40 can be provided in the form of a roll of safety seal tape 38. The safety seal tape 40 has an outer side 42 and an inner side 44. A pressure sensitive adhesive (not shown) substantially coats the inner side 44 of the safety seal tape 40. As shown in FIG. 1, the adhesive is capable of removably bonding the tape 40 to the lid 12 and the water cooler 10 to thereby tightly seal the lid 12 on the water cooler 10 and prevent contamination of the potable water. The adhesive can be covered with a removable backing to prevent the adhesive from sticking to an object until the backing has been removed from the tape 40.

The outer side 42 of the safety seal tape 40 has repeating indicia 48 imprinted thereon. The repeating indicia 48 indicate that the lid 12 is not to be removed from the cooler. It is also preferable to include indicia indicating that the water cooler 10 contains potable water, since this label is required by 29 C.F.R. § 1926.51(a)(3). A preferred indicia 48 consists of repeating units of the phrase "—potable water seal—do not remove." Any phrase capable of providing notice that the lid 12 is not to be removed and/or that the water cooler 10 contains potable water will suffice for indicia 48. The indicia 48 can be printed in multiple languages, such as English and Spanish.

Figure 4:
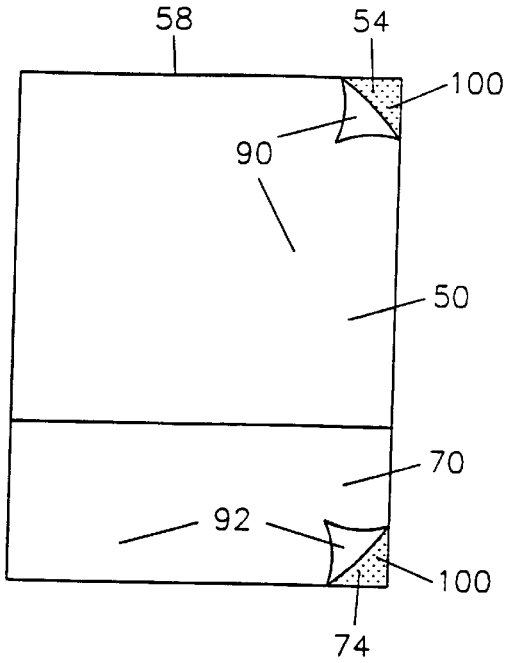
FIG. 4 is a rear view of an inner side of one embodiment of a safety tag according to the invention, showing a pressure sensitive adhesive covered with a removable safety tag backing and a removable detachable label backing, the backings being partially peeled away to show the relationship between the backings and the adhesive.
Figure 5:
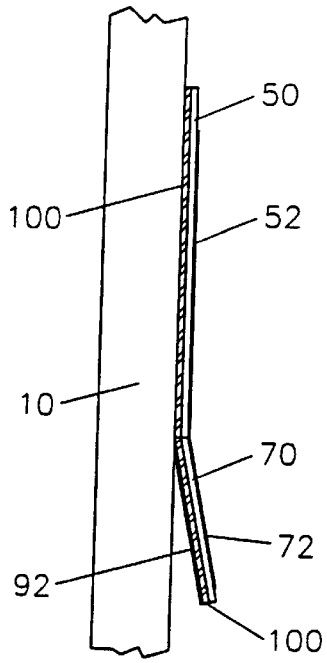
FIG. 5 is a cross-sectional view of one embodiment of a safety tag according to the invention adhered to a water cooler, showing a detachable label having a removable backing covering an adhesive (adhesive shown in representational form), such that the detachable label does not adhere to the water cooler when the removable backing is in place.

As shown in FIG. 3, the safety tag 50 has an outer side 52 and an inner side 54. The outer side 52 of the tag 50 has indicia 68 imprinted thereon. As shown in FIGS. 4 and 5, a pressure sensitive adhesive 100 is provided on at least a portion of the inner side 54 of the tag 50. The adhesive is capable of removably bonding the tag 50 to the lid 12 and/or the water cooler 10 to thereby adhere the tag 50 to the water cooler 10. As with the safety seal tape 40, the adhesive on the tag 50 can be covered with a removable backing 90 to prevent the adhesive 100 from sticking to an object until the backing 90 has been removed from the tag 50. The tag 50 can be placed anywhere on the cooler 10, including on safety seal tape 40 and on the lid 12.

The indicia 68 on safety tag 50 indicate that the cooler 10 contains potable water. Preferred indicia 68 are shown in FIG. 3. The indicia 68 can be printed in multiple languages, such as English and Spanish. In addition to providing warnings, the indicia are intended to provide numerous options for recording and verifying when a water cooler was filled with potable water. The indicia 68 on the safety tag 50 preferably include indicators for one or more spaces 62 for recording information about the potable water on the safety tag 50, such as the date and time the cooler 10 was filled with potable water and sealed with the safety seal 40. The indicia 68 also preferably include a serial number 65. The serial number 65 is selected from a sequential series of serial numbers, such that a plurality of labels 50 bearing a sequential series of serial numbers 65 can be provided to an employer. The labels 50 can be provided with a means for using the labels in sequence, such as a label dispenser (not shown).

Figure 6:
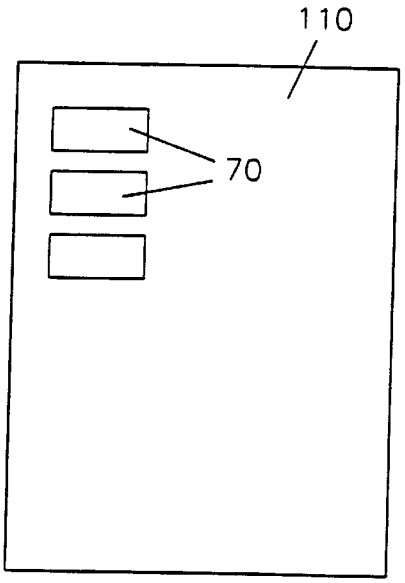
FIG. 6 is a frontal view of a log showing detachable labels adhered to the log.

As part of the labeling and recording system, the safety tag 50 can be provided with a detachable label 70, as shown in FIG. 3. The detachable label 70 preferably has a second serial number 85 imprinted on an outer side 72 thereof. The second serial number 85 is the same number as the serial number 65 on the safety tag 50. The detachable label 70 can also be provided with indicia 88, including indicia 88 for one or more spaces 82 for recording information about the potable water on the safety tag 50, such as the date and time the cooler 10 was filled with potable water and sealed with the safety seal 40. As shown in FIGS. 4 and 5, the detachable label 70 is also preferably provided with a pressure sensitive adhesive 100 on an inner side 74 of the detachable label. The adhesive on the detachable label 70 is preferably covered with a removable backing 92 such that the adhesive does not adhere to the water cooler when the backing is in place. When the detachable label 70 is removed from the safety tag 50, the backing 92 can be removed to expose the adhesive. As shown in FIG. 6, and as will be described further below, the detachable label 70 can then be adhered to a log 110 or other such record, thereby providing a record of when that particular safety tag 50 was applied to a cooler 10.

Figure 7:
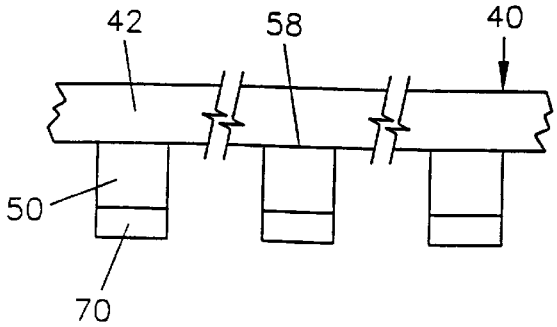
FIG. 7 is a representational view of one embodiment of the invention showing a length of safety seal tape having an upper portion of safety tags connected to an edge of the safety seal tape.

As shown in FIG. 7, the safety seal tape 40 can be connected to the safety tag 50, such as with an upper portion 58 of the tag 50 connected to an edge of the safety seal tape 40. In this embodiment, the safety tags 50 can be spaced out along a roll of tape 38, and the safety tag 50 thus provides a marker for when enough tape 40 has been applied to secure and seal the lid 12, whereupon the adhered tape 40 is then cut or broken from the roll of tape 38.

Numerous types of tape can be used for the safety seal tape 40. The preferred criteria are (1) that the tape is relatively inexpensive, since large amounts of tape will be used and discarded on a daily basis; (2) that the tape surface can be imprinted with repeating indicia; (3) that when wrapped a few times around the lid and cooler the tape is of sufficient strength that the lid cannot be opened by a person without first removing or unpeeling at least some of the tape; (4) that when not wrapped around the lid and cooler, the tape can be torn or cut, such that pieces can be separated as required from a roll of tape, and (5) that the tape can be removed/unpeeled from the lid and cooler without undue effort, since the tape will generally need to be removed on a daily basis. The preferred type of tape falls into a general category commonly known as pipewrap tape. Examples of other types of tape which may be used include duct, masking tape, vinyl plastic, nylon, polyester unidirectional glass reinforced, polyethylene waterproof, polypropylene, saturated crepe coated, polyvinyl, vinyl, polyester coated, double coated cloth, double coated flatback paper, waterproof polyethylene, polyvinyl chloride, thread seal, tensilized polypropylene, polyester glass reinforced, embossed plastic, bopp-glass reinforced, and woven plastic tape. The safety tags 50 can be made of the same materials as the tape 40. The tape 40 and tags 50 can be manufactured and imprinted by a tape and label manufacturer, such as National Tape Corporation, 5128 Storey Street, P. O. Box 23887, New Orleans, La. 70183-0887. The tape 40, tape indicia 48, tags 50, and tag indicia 68, can be brightly colored to provide contrast and make the safety seal tape 40, tags 50, and indicia 48, 68 noticeable and readily visible on the cooler 10.

Numerous adhesives can be used for coating the inner side 44 of the tape 40 and the inner side 54 of the safety tag 50. The preferred criteria are (1) that the adhesive will adhere the tape and/or tag to the outer surface of conventional water coolers and lids, which are usually made of plastic, (2) that when the tape is wrapped a few times around the lid and cooler, the adhesive will adhere with sufficient strength that the lid cannot be opened by a person without first removing or unpeeling at least some of the tape, and (3) that the tape and/or tag can be removed/unpeeled from the lid and cooler without undue effort, since the tape will generally need to be removed on a daily basis. The preparation and composition of adhesives is a well known field, with many suitable adhesives readily available on the open market for practicing the invention. The most commonly used adhesives will be rubber, aggressive synthetic rubber, butyl rubber, and aggressive adhesives, and combinations of these adhesives. Tape coated with suitable adhesives can be obtained from National Tape Corporation, 5128 Storey Street, P. O. Box 23887, New Orleans, La. 70183-0887.

In operation, the apparatus of the invention is used according to the following preferred methods. First, a water cooler 10 is cleaned and then filled with potable water. The opening of the water cooler is then tightly closed with a clean lid. The safety seal tape 40 is then wrapped around the closed lid 12 and the water cooler 10 such that the inner side 44 of the tape 40 adheres to the water cooler 10 and the closed lid 12 to thereby secure the closed lid 12 on the water cooler 10, and such that the repeating indicia 48 on the outer surface 42 of the safety seal tape 40 are visible on the water cooler 10 to thereby label the water cooler 10. A safety tag 50 is then adhered to the water cooler 10 such that the indicia on the tag are visible on the water cooler 10, to thereby label the water cooler 10. If the adhesive on the safety seal tape 40 or the safety tag 50 is covered with a backing 90, the backing must be peeled off before the tape 40 or tag 50 can be adhered to the water cooler 10.

Once the lid is secured and the cooler labeled, numerous recording systems can be used to preserve records of the inspection and labeling, depending on what type of safety tag 50 is provided and on the requirements or desires of the employer. If spaces 62 are provided on the tag 50, the date and time when the water cooler was filled with potable water and secured with the safety seal tape 40 can be recorded in the spaces 62. The identity of the preparer or inspector, the owner of the water cooler, the assigned letter or number of the cooler, the job number, and other such information can also be recorded on the tag 50. While on the cooler 10, the safety tag 50 serves as notice to employees and OSHA that the cooler 10 contains fresh, potable water. After the potable water has been used up, the tag can be removed and preserved as a record of when the cooler was filled and inspected.

If spaces 82 are provided on a detachable label 70, similar information can be recorded on the detachable label 70. The detachable label 70 can be detached from the safety tag 50 and preserved as a record. If the detachable label 70 is provided with an adhesive 100, the backing 92 can be removed to expose the adhesive 100, and pressure can be applied to the label 70 to adhere the label 70 to a log 110. For example, the labels 70 for all safety tags 50 used on a particular day can be placed on a sheet bearing that particular date, and the sheet can be preserved in a notebook or file.

If the safety tag 50 is provided with a serial number 65, the serial number 65 can be recorded in a log 110 according to the date on which the tag 50 imprinted with that particular serial number 65 was adhered to the water cooler 10. If a serial number 85 is provided on a detachable label 70, the detachable label 70 can be detached from the safety tag 50 and preserved as a record. If the detachable label 70 is provided with an adhesive 100, the backing 92 can be removed to expose the adhesive, and pressure can be applied to the label 70 to adhere the label 70 with imprinted serial number 85 onto a log 110.

As can be appreciated, the methods of the invention provide a flexible system which can be used or elaborated upon to maintain a recording system for substantiating compliance with 29 C.F.R. § 1926.51(a) or other applicable regulations. Although the invention is designed for use on construction sites, manufacturing plants, and other industrial and commercial settings, the invention will also contribute to preserving potable water sources in sporting and recreational settings, such as stadium events, trade shows, and festivals.

Although the present invention has been described in terms of specific embodiments, it is anticipated that alterations and modifications thereof will no doubt become apparent to those skilled in the art. It is therefore intended that the following claims be interpreted as covering all such alterations and modifications that fall within the true spirit and scope of the invention.

What is claimed is:

1. A method of securing a closed lid on a water cooler having a tap and containing potable water and for labeling said water cooler comprising the steps of:

imprinting an outer side of a safety seal tape with repeating indicia, said repeating indicia indicating that said lid is not to be removed from said cooler, an inner side of said tape having a pressure sensitive adhesive thereon, said adhesive capable of removably bonding said safety seal tape to said water cooler and said lid, imprinting an outer side of a safety tag with indicia, said indicia indicating that said cooler contains potable water, an inner side of said tag having a pressure sensitive adhesive on at least a portion thereof, said adhesive capable of removably bonding said tag to said water cooler and said lid, wrapping said safety seal tape around said closed lid and said water cooler such that said inner side of said tape adheres to said water cooler and said closed lid to thereby secure said closed lid on said water cooler, and such that said repeating indicia on said outer surface of said safety seal tape are visible on said water cooler to thereby label said water cooler, and adhering said safety tag to said water cooler such that said indicia on said tag are visible on said water cooler to thereby label said water cooler.

2. The method of claim 1 wherein said repeating indicia consists of repeating units of a phrase "—portable water seal—do not remove."

3. The method of claim 1 wherein said indicia imprinted on said safety tag include indicators for one or more spaces for recording information about said potable water on said safety tag.

4. The method of claim 3 wherein said indicia imprinted on said safety tag include a serial number, said serial number selected from a sequential series of serial numbers.

5. The method of claim 4 further comprising providing a detachable label on said safety tag, said label having indicia imprinted on an outer side thereof, said indicia on said detachable label including indicators for one or more spaces for recording information about said potable water on said detachable label.

6. The method of claim 5 wherein said indicia imprinted on said detachable label further include a second serial number, said second serial number being a same number as said serial number on said safety tag.

7. The method of claim 6 further comprising providing a pressure sensitive adhesive on an inner side of said detachable label, said adhesive covered with a removable backing such that said adhesive does not adhere to said water cooler when said backing is in place.

8. The method of claim 3 further comprising providing a detachable label on said safety tag, said label having indicia imprinted on an outer side thereof, said indicia on said detachable label including indicators for one or more spaces for recording information about said potable water on said detachable label.

9. The method of claim 8 further comprising providing a pressure sensitive adhesive on an inner side of said detachable label, said adhesive covered with a removable backing such that said adhesive does not adhere to said water cooler when said backing is in place.

10. The method of claim 1 wherein said indicia imprinted on said safety tag include a serial number, said serial number selected from a sequential series of serial numbers.

11. The method of claim 10 further comprising providing a detachable label on said safety tag, said label having indicia imprinted on an outer side thereof, said indicia imprinted on said detachable label including a second serial number, said second serial number being a same number as said serial number on said safety tag.

12. The method of claim 11 said indicia on said detachable label further including indicators for one or more spaces for recording information about said potable water on said detachable label.

13. The method of claim 12 further comprising providing a pressure sensitive adhesive on an inner side of said detachable label, said adhesive covered with a removable backing such that said adhesive does not adhere to said water cooler when said backing is in place.

14. The method of claim 12 further comprising providing a pressure sensitive adhesive on an inner side of said detachable label, said adhesive covered with a removable backing such that said adhesive does not adhere to said water cooler when said backing is in place.

15. The method of claim 3 further comprising recording in said one or more spaces on said tag the date on which said water cooler was filled with potable water and secured with said safety seal tape.

16. The method of claim 4 further comprising recording said serial number in a log according to a date on which said tag imprinted with said serial number was adhered to said water cooler.

17. The method of claim 5 further comprising recording in said spaces on said detachable label a date on which said water cooler was filled with potable water, and detaching said detachable label from said safety tag.

18. The method of claim 8 further comprising recording in said spaces on said detachable label a date on which said water cooler was filled with potable water, and detaching said detachable label from said safety tag.

19. The method of claim 9 further comprising recording in said one or more spaces on said detachable label a date on which said water cooler was filled with potable water and secured with said safety seal tape, detaching said detachable label from said safety tag, removing said backing from said label, and applying pressure to said label to adhere said detached label to a log.

20. The method of claim 10 further comprising recording said serial number in a log according to a date on which said tag imprinted with said serial number was adhered to said water cooler.

21. The method of claim 12 further comprising recording in said spaces on said detachable label a date on which said water cooler was filled with potable water, and detaching said detachable label from said safety tag.

22. The method of claim 13 further comprising detaching said detachable label from said tag, removing said backing from said label, and applying pressure to said label to adhere said detached label to a log.

23. The method of claim 14 further comprising detaching said detachable label from said tag, removing said backing from said label, and applying pressure to said label to adhere said detached label to a log.

24. The method of claim 1 wherein an upper portion of said tag is connected to an edge of said safety seal tape.

25. A method of securing a closed lid on a water cooler having a tap and containing potable water and for labeling said water cooler comprising the steps of:

providing a roll of safety seal tape, said safety seal tape having an outer side imprinted with repeating indicia, said repeating indicia indicating that said lid is not to be removed from said cooler, an inner side of said tape having a pressure sensitive adhesive thereon, said adhesive capable of removably bonding said safety seal tape to said water cooler and said lid, providing a safety tag, said safety tag having an outer side imprinted with indicia, said indicia indicating that said cooler contains potable water, an inner side of said tag having a pressure sensitive adhesive on at least a portion thereof, said adhesive capable of removably bonding said tag to said water cooler and said lid, separating a piece of said safety seal tape from said roll, wrapping said separated piece of safety seal tape at least once around said closed lid and said water cooler such that said inner side of said tape adheres to said water cooler and said closed lid to thereby secure said closed lid on said water cooler, said safety seal tape and said adhesive on said safety seal tape together being of sufficient strength that said taped closed lid cannot be removed from said water cooler without first unpeeling at least a portion of said tape, and such that said repeating indicia on said outer surface of said safety seal tape are visible on said water cooler to thereby label said water cooler, and adhering said safety tag to said water cooler such that said indicia on said tag are visible on said water cooler to thereby label said water cooler.

* * * * *